US007739941B2

(12) United States Patent
Noble et al.

(10) Patent No.: US 7,739,941 B2
(45) Date of Patent: Jun. 22, 2010

(54) HYDRAULIC DRIVE SYSTEM AND METHOD OF OPERATING A HYDRAULIC DRIVE SYSTEM

(75) Inventors: Stephen Noble, West Vancouver (CA); Greg Harper, Vancouver (CA); Thomas Brook, Shawnigan Lake (CA)

(73) Assignee: Westport Power Inc., Vancouver, BC (CA)

( * ) Notice: Subject to any disclaimer, the term of this patent is extended or adjusted under 35 U.S.C. 154(b) by 208 days.

(21) Appl. No.: 11/679,174

(22) Filed: Feb. 26, 2007
(Under 37 CFR 1.47)

(65) Prior Publication Data

US 2009/0077957 A1 Mar. 26, 2009

Related U.S. Application Data

(63) Continuation of application No. PCT/CA2005/001218, filed on Aug. 5, 2005.

(30) Foreign Application Priority Data

Aug. 27, 2004 (CA) ..... 2476032

(51) Int. Cl.
*F15B 15/28* (2006.01)
*F15B 15/00* (2006.01)

(52) U.S. Cl. ..... 91/363 R; 92/181 R

(58) Field of Classification Search ..... 91/358 R, 91/363 R, 392, 401; 92/164, 181 R, 183, 92/181 P See application file for complete search history.

(56) References Cited

U.S. PATENT DOCUMENTS 3,182,563 A * 5/1965 Neilan ..... 91/401
4,213,298 A 7/1980 Milgram
4,337,687 A * 7/1982 Hoover ..... 91/401
2001/0037689 A1 11/2001 Krouth et al.
2003/0079603 A1 * 5/2003 Schumacher et al. ..... 91/361
2003/0106381 A1 6/2003 Krouth et al.

FOREIGN PATENT DOCUMENTS

| | | |
|---|---|---|
| CA | 1247984 | 1/1989 |
| CA | 2024074 | 4/1991 |
| CA | 2183289 | 2/1997 |
| CA | 2398559 | 8/2001 |
| CA | 2360314 | 5/2002 |
| JP | 55-083541 | 6/1980 |
| JP | 58-166106 | 1/1983 |
| JP | 02-085502 | 3/1990 |
| JP | 09-323193 | 12/1997 |

* cited by examiner

*Primary Examiner*—Thomas E Lazo
(74) *Attorney, Agent, or Firm*—McAndrews, Held & Malloy, Ltd.

(57) ABSTRACT

A hydraulic drive system comprises a hydraulic actuator comprising a piston reciprocable between two cylinder heads for actuating a machine. A flow switching device reverses the direction of hydraulic fluid flow to and from chambers on opposite sides of the piston. The piston stops at the end of each piston stroke when a shuttle valve associated with the piston opens to allow hydraulic fluid to flow between the chambers cancelling the differential pressure that acts on the piston to cause reciprocal movement. A controller is programmed to determine when the piston reaches the end of each stroke based upon at least one of hydraulic pump speed, hydraulic fluid pressure, or elapsed time, with each of these measured during each stroke. The controller then sends an electronic signal to command the flow switching device to reverse the direction of hydraulic fluid flow.

32 Claims, 7 Drawing Sheets

HYDRAULIC DRIVE SYSTEM AND METHOD OF OPERATING A HYDRAULIC DRIVE SYSTEM

CROSS-REFERENCE TO RELATED APPLICATION(S)

This application is a continuation of International Application No. PCT/CA2005/001218, having an international filing date of Aug. 5, 2005, entitled "Hydraulic Drive System And Method Of Operating A Hydraulic Drive System". International Application No. PCT/CA2005/001218 claimed priority benefits, in turn, from Canadian Patent Application No. 2,476,032 filed Aug. 27, 2004. International Application No. PCT/CA2005/001218 is hereby incorporated by reference herein in its entirety.

FIELD OF THE INVENTION

The present invention relates to a hydraulic drive system and a method of operating a hydraulic drive system. More particularly, the invention relates to a system and method that employs a reciprocating hydraulically actuated piston connectable to a machine by a piston rod.

BACKGROUND OF THE INVENTION

Hydraulic drive systems that employ a reciprocating piston can be employed to provide reciprocating actuation for a wide variety of applications. With such drive systems, the hydraulic piston travels within a cylinder between two opposite cylinder heads. To move the hydraulic piston in one direction hydraulic fluid is delivered from a hydraulic pump to a first chamber that is associated with one side of the hydraulic piston while hydraulic fluid is drained from a second chamber that is associated with the other side of the hydraulic piston. To reverse the direction that the hydraulic piston is traveling, the hydraulic fluid flow direction is reversed so that hydraulic fluid is drained from the first chamber and hydraulic fluid from the hydraulic pump is delivered to the second chamber. A piston rod is attached to the hydraulic piston at one end and to the machine to be driven at the other end, and in this way, the hydraulic drive system can provide reciprocating movement to the machine to which it is operatively connected. For many applications, the efficiency and performance of the machine depends upon the hydraulic piston traveling a consistent distance in each actuation stroke. An example of a machine with such a requirement is a reciprocating piston pump because the hydraulic drive system drives a reciprocating pump piston and the efficiency and performance of such a pump relies upon a consistent pump piston stroke that reduces dead volume at the end of each power stroke. Accordingly, there is a need for hydraulic drive systems with hydraulic piston actuators that can provide piston strokes of consistent length.

Hydraulic cylinders can be designed with a piston stop that provides a physical limit for stopping the piston at the cylinder head or at a shoulder near the cylinder head. However, to reduce noise, wear and/or to prevent more severe damage to the piston stop, a means of detecting when the piston has reached the piston stop is needed so that the hydraulic fluid flow can be reversed to switch the direction of piston movement.

Conventional hydraulic actuators are known to employ position sensors, such as magnetic switches, for detecting when the actuator piston has reached the piston stop that defines the end of a piston stroke. When the position sensor detects the hydraulic piston the sensor sends a signal to a controller and the controller commands a flow-switching valve to reverse the hydraulic fluid flow so that the hydraulic piston reverses direction. A disadvantage of such conventional arrangements is that it requires at least one position sensor that adds to the cost of the system. With conventional arrangements such as this it can also be difficult to adjust the timing for reversing hydraulic fluid flow responsive to changes in hydraulic fluid flow rate, which affects piston velocity. In addition, conventional systems like this often require a pressure relief valve to prevent over-pressurization of the hydraulic system, for example, if there is a malfunction of the position sensor.

U.S. Patent Application Publication No. US2003/0079603 A1 (application Ser. No. 10/317,311), entitled "System For Controlling Hydraulic Actuator" discloses a method whereby a fluid flow sensor is employed to measure the hydraulic fluid flow traveling into and out of the hydraulic actuator cylinder. With the known dimensions of the hydraulic actuator cylinder it is possible to measure the hydraulic fluid flow rate and calculate the position of the piston. With this information it is also possible to calculate the velocity of the piston and the direction of movement. However, fluid flow sensors are relatively expensive, and in a hydraulic system that employs a plurality of actuators, a fluid flow sensor is needed for each actuator. Also, the precision of such a system is dependent very much upon the accuracy of the fluid flow sensor.

U.S. Pat. No. 4,213,298 (the '298 patent) discloses a self-reversing hydraulic control system that uses only mechanical devices for reversing hydraulic fluid flow. A special flow-sensing valve senses changes in hydraulic fluid pressure that are indicative of when the hydraulic piston has come against a physical limit. The flow-sensing valve diverts hydraulic fluid to flow to valves that hydraulically actuate a hydraulic fluid flow-switching device that reverses hydraulic fluid flow to reverse the direction of movement of the hydraulic piston. In the '298 patent, the inventors claim that their invention is particularly advantageous for marine applications where electrical components can be adversely affected by long term exposure to salt air and salt water. Another feature noted by the '298 patent is that the flow-sensing valve also operates to change the hydraulic piston direction when the hydraulic piston is blocked by an obstacle before completing a piston stroke. However, a disadvantage of this solution is that it requires more mechanical components, which require more space, add more weight to the system, and add to manufacturing and maintenance costs.

Canadian Patent No. 1,247,984 discloses a valve for use with hydraulic ram assemblies. The valve operates to inhibit fluid by-pass through the piston when the piston changes direction as a result of either shock loading or intentionally high operational loading. According to the '984 patent, the sudden or abrupt change in direction of the piston can be responsible for reverse flow or by-pass of fluid from the non-pressure side of the piston to the pressure side, before and/or after impact or contact with the pushrod and cylinder end. An objective of the valve disclosed by the '984 patent is to alleviate fluid leakage or by-pass through the piston by providing a valve that comprise a chamber that is held closed to the low pressure side and that can open to the pressure side responsive to a pressure pulse caused by shock loading. The disclosed valve comprises two valve members that are each biased in respected closed positions by a spring. By allowing hydraulic fluid to flow into the valve chamber, the valve acts as a means for relieving hydraulic pressure and reducing the magnitude of the pressure pulses in the high-pressure side. Hydraulic fluid can flow through the valve when the piston is at the end of a piston stroke. A disadvantage of the valve disclosed by the '984 patent is the number of parts. In addition, the '984 patent does disclose a method of controlling the timing for switching piston direction.

Accordingly, there is a need for a simpler, less expensive hydraulic system and method of effectively controlling the reversal of piston movement at the end of each piston stroke, without the use of position sensors, flow rate sensors, or special flow-sensing valves.

SUMMARY OF THE INVENTION

A hydraulic drive system comprises components that cooperate with one another to deliver reciprocating motion and to provide piston strokes of consistent length. The system comprises:

(a) an actuator comprising a piston disposed within a cylinder and reciprocable between two cylinder heads, whereby the piston divides the cylinder into respective first and second hydraulic fluid chambers and a piston stroke is defined by the piston traveling from a first predetermined position near one of the cylinder heads to a second predetermined position near the other one of the cylinder heads;

(b) at least one piston rod comprising a first end connected to the piston and a second end extending through one of the two cylinder heads and out of the cylinder;

(c) a flow switching device comprising a flow switching member that is actuatable between at least two positions by an actuator that is activatable by an electronic signal to reverse the direction of hydraulic fluid flow to or from the first and second hydraulic fluid chambers so that hydraulic fluid flows into one of the first or second hydraulic fluid chambers when hydraulic fluid is flowing out of the other one of the first or second hydraulic fluid chambers;

(d) a hydraulic pump comprising a discharge outlet and a suction inlet;

(e) high pressure conduits for respective fluids connections between each one of the first and second hydraulic fluid chambers and respective fluid couplings of the flow switching device, and between an inlet of the flow switching device and the discharge outlet;

(f) low pressure conduits for connecting an outlet of the flow switching device to a hydraulic fluid reservoir and the hydraulic fluid reservoir to the suction inlet, or for connecting the outlet of the flow switching device directly to the suction inlet;

(g) a shuttle valve and a fluid passage through the piston wherein the shuttle valve is operable to close the fluid passage when the piston is moving during one of the piston strokes, and to open the fluid passage when the piston is at the end of one of the piston strokes; and (h) a controller that is programmed to:

determine when the piston has reached the end of each piston stroke based upon at least one of hydraulic pump speed, hydraulic fluid pressure, or elapsed time, all measured during each piston stroke; and send an electronic signal to the flow switching device to command the flow switching member to be actuated from one position to another position to reverse the hydraulic fluid flow when the controller determines that the piston has reached the end of each piston stroke.

In a preferred embodiment the controller is configured to receive a signal indicative of hydraulic pump speed and is programmed to:

determine hydraulic fluid flow rate based upon hydraulic pump speed by referencing a look-up table that indicates hydraulic fluid flow rates corresponding to respective pump speeds;

measure the elapsed time for each piston stroke;

calculate the volume of hydraulic fluid that has flowed into the one of the first and second hydraulic fluid chambers into which hydraulic fluid is flowing; and determine when the piston has reached the end of a piston stroke by determining when the calculated volume is equal to or greater than a known volume that is required to fill the one of the first and second hydraulic fluid chambers into which hydraulic fluid is flowing.

In another preferred embodiment the controller is configured to receive a signal indicative of hydraulic fluid pressure at a location at or between the hydraulic pump discharge and the hydraulic fluid chamber into which hydraulic fluid is flowing, and is programmed to determine when the piston has reached the end of a piston stroke by determining when the shuttle valve has opened and the hydraulic fluid pressure drops below a predetermined value.

In yet another preferred embodiment the hydraulic pump is operable at a constant speed and the controller is programmed to determine when the piston has reached the end of each piston stroke by measuring the elapsed time for each piston stroke, and determining that the piston has reached the end of a piston stroke when the hydraulic pump has operated for a predetermined time, measured from the beginning of each piston stroke.

The flow switching device preferably comprises at least one solenoid that can receive the electronic signal from the controller. The solenoid is operable to actuate the flow switching member when it receives the electronic signal from the controller.

In a preferred embodiment the flow switching device is a four-way spool valve. The spool valve can be a two-position or three-position spool valve. With a four-way two-position spool valve the flow switching member comprises a spool member selectively movable to a first position wherein the first hydraulic fluid chamber is fluidly connected to receive hydraulic fluid from the hydraulic pump discharge outlet and the second hydraulic fluid chamber is fluidly connected to drain the hydraulic fluid through one of the low pressure conduits. When the spool member is in a second position the second hydraulic fluid chamber is fluidly connected to receive hydraulic fluid from the hydraulic pump discharge outlet and the first hydraulic fluid chamber is fluidly connected to drain the hydraulic fluid through one of the low pressure conduits. With a four-way three-position spool valve, a third position for the spool member is added wherein the hydraulic pump discharge outlet is in fluid communication with one of the low pressure conduits through which hydraulic fluid is returnable to the hydraulic fluid reservoir. In an open hydraulic system fluid in the hydraulic fluid reservoir is at atmospheric pressure, and the hydraulic fluid is returned from the flow switching valve to the reservoir. In a closed hydraulic system, the hydraulic fluid is returned from the flow switching valve to a low pressure conduit that delivers hydraulic fluid to the suction inlet of the hydraulic pump. Open hydraulic systems are simpler to operate and are more common.

The shuttle valve preferably comprises a valve member that is movable between two closed positions. The shuttle valve is in an open position when the valve member is positioned between the two closed positions and when both of the sealing surfaces of the valve member are spaced apart from respective associated valve seats. When the flow switching device reverses the direction of hydraulic fluid flow, the valve member is movable under the influence of a differential pressure that develops between the first and second hydraulic fluid chambers. A higher pressure builds in the hydraulic fluid chamber into which hydraulic fluid is being pumped, while pressure in the other hydraulic fluid chamber drops to drain pressure as hydraulic fluid within that chamber flows to the reservoir or the hydraulic pump suction inlet. The valve member moves towards the one of the first and second hydraulic fluid chambers from which hydraulic fluid is flowing until the valve member is seated in one of the closed positions. The valve member is movable to an open position between the two closed positions near the end of each piston stroke when a stern portion of the valve member contacts one of the cylinder heads, so that further movement of the piston causes the valve member to be lifted away from a valve seat where it was at one of the closed positions.

The valve member can comprises opposite cone-shaped ends that face cooperatively shaped seating areas of the piston. Each of the cone-shaped ends has an associated stem extending therefrom. The respective stems are elongated so that one of them can extend from the piston into the one of the first and second hydraulic fluid chambers out from which the hydraulic fluid is flowing when the valve member is seated in one of the two closed positions.

The hydraulic pump can be mechanically driven by an internal combustion engine. For example, if the hydraulic drive system is employed to actuate machinery associated with the engine; such as a fuel pump, the hydraulic pump can be conveniently driven by the engine. To reduce pollution originating from engine emissions, engines using cleaner burning fuels such as natural gas and hydrogen are being developed. The presently disclosed hydraulic drive system could be employed to drive a cryogenic pump for pumping liquefied natural gas from a fuel tank to the engine's combustion chambers. In a preferred embodiment for a hydraulic drive system with an engine driven hydraulic pump, the controller can be configured to receive a signal from an engine speed sensor from which the controller can calculate that speed of the hydraulic pump.

In another embodiment the controller can be configured to send a command signal to the hydraulic pump to operate at a speed that is required to operate a machine operatively connected to the second end of the piston rod at a desired speed. The speed for the hydraulic pump that is commanded by the controller can be employed by the controller to calculate the end of the piston stroke.

The controller can be programmed to add a predetermined delay to the timing for sending the electronic signal to the flow switching device so that the piston is stationary for at least a predetermined time between each piston stroke. Factors such as component wear or transient speed conditions can cause variances between the calculated time when the piston reaches the end of a piston stroke and the actual time when this occurs. Accordingly, the controller can ensure that the piston completes its piston stroke before the hydraulic fluid flow is reversed by including a predetermined delay. However, energy is wasted while the piston is stopped and the hydraulic fluid flows through it, so it is preferable to keep the length of the delay short. An advantage of the disclosed hydraulic system is that the open shuttle valve stops piston movement independently from the reversal of hydraulic fluid flow so there is no danger of over-pressurizing the hydraulic cylinder and there is no need for a pressure relief valve.

Another preferred embodiment of the hydraulic drive system comprises components that cooperate with one another to deliver reciprocating motion and to provide piston strokes of consistent length. The system comprises:

(a) an actuator comprising a piston disposed within a cylinder and reciprocable between two cylinder heads, whereby the piston divides the cylinder into respective first and second hydraulic fluid chambers and a piston stroke is defined by the piston traveling from a first predetermined position near one of the cylinder heads to a second predetermined position near the other one of the cylinder heads;

(b) at least one piston rod comprising a first end connected to the piston and a second end extending through one of the two cylinder heads and out of the cylinder;

(c) a flow switching device comprising a flow switching member that is actuatable between at least two positions to reverse the direction of hydraulic fluid flow to or from the first and second hydraulic fluid chambers so that hydraulic fluid flows into one of the first or second hydraulic fluid chambers when hydraulic fluid is flowing out of the other one of the first or second hydraulic fluid chambers;

(d) a hydraulic pump comprising a discharge outlet and a suction inlet;

(e) high pressure conduits for respective fluid connections between each one of the first and second hydraulic fluid chambers and respective fluid couplings of the flow switching device, and between an inlet of the flow switching device and the discharge outlet;

(f) low pressure conduits for connecting an outlet of the flow switching device to a hydraulic fluid reservoir and the hydraulic fluid reservoir to the suction inlet, or for connecting the outlet of the flow switching device directly to the suction inlet; and (g) a shuttle valve and a fluid passage through the piston wherein the shuttle valve is operable to close the fluid passage when the piston is moving during one of the piston strokes and to open the fluid passage when the piston is at the end of one of the piston strokes, and wherein the shuttle valve comprises a valve member shaped with two sealing surfaces associated with opposite ends of the valve member. The valve member is movable between two closes positions where the sealing surfaces can cooperate with respective valve seats to seal the fluid passage, with the valve member being in an open position when the valve member is disposed between the two closed positions with both of the sealing surfaces spaced apart from the respective valve seats.

In operation, the fluid passage and the shuttle valve are sized such that when the shuttle valve is in the open position, movement of the piston is halted.

A method of operating a hydraulic drive system comprises:

reciprocating a hydraulic piston within a cylinder by reversing the direction of hydraulic fluid flow to the cylinder to alternate between:

delivering hydraulic fluid from a reservoir to a first hydraulic fluid chamber associated with one side of the hydraulic piston while draining hydraulic fluid to the reservoir from a second hydraulic fluid chamber associated with an opposite side of the hydraulic piston, and delivering hydraulic fluid from the reservoir to the second hydraulic fluid chamber while draining hydraulic fluid to the reservoir from the first hydraulic fluid chamber;

mechanically actuating a shuttle valve when the hydraulic piston is a predetermined distance from a cylinder head to fluidly connect the first hydraulic fluid chamber to the second hydraulic fluid chamber while one of the first or second hydraulic fluid chambers is fluidly connected to the reservoir, thereby halting movement of the hydraulic piston and defining an end position for a piston stroke;

determining when the hydraulic piston reaches the end position based upon measurements taken during the piston stroke of at least one of hydraulic pump speed, hydraulic fluid pressure, or elapsed time; and when it has been determined that the hydraulic piston has reached the end position, sending an electronic signal to actuate a flow switching device to reverse the hydraulic fluid flow direction, whereupon the shuttle valve closes and the hydraulic piston commences a new piston stroke, moving in a direction opposite to movement of the piston during the piston stroke just ended.

In preferred embodiments, the shuttle valve is mechanically actuated to open when the piston is a predetermined distance from the cylinder head. The shuttle valve comprises a valve member that has a stem that extends towards the cylinder head, and when the piston is moving towards the cylinder head, contact between the stem and the cylinder head causes the valve member to be lifted away from a valve seat so that the valve member slides from a closed position to an open position. In the preferred method, the valve member is slidable from the open position back to the closed position by reversing the direction of hydraulic fluid flow and applying a differential pressure to the first and second hydraulic fluid chambers. The differential pressure acts on the shuttle valve member to move it towards a valve seat against which it is urged when in the closed position. An advantage of the preferred method and apparatus is that the shuttle valve can be very simple in construction, requiring only a valve member disposed in a valve cylinder, since it only requires differential fluid pressure and contact with the cylinder heads for actuation and shuttle valve actuation is independent from flow switching.

In one preferred method the step of determining when the hydraulic piston reaches the end position comprises determining the speed of a hydraulic pump that pumps the hydraulic fluid to the cylinder, referencing a look-up table that indicates hydraulic fluid flow rates corresponding to pump speeds, and calculating when the volume of hydraulic fluid delivered to a hydraulic fluid chamber equals a known volume that is required to fill the first or second hydraulic fluid chamber by a respective piston stroke.

In a second preferred method the step of determining when the hydraulic piston reaches the end position comprises monitoring hydraulic fluid pressure at a location where the measured pressure correlates to pressure within the one of the first and second hydraulic fluid chambers that is being filled with hydraulic fluid, and determining that the piston is at the end of each piston stroke when the measured pressure drops below a predetermined threshold value. When the method comprises monitoring hydraulic fluid pressure, the method can further comprise changing the predetermined threshold value by referencing a look-up table whereby the predetermined threshold value is determined as a function of hydraulic pump speed or the direction the piston is traveling. The method can also further comprise shutting down the hydraulic drive system if hydraulic fluid pressure in the first or second hydraulic fluid chambers rises above a predetermined maximum system pressure.

In a third preferred method comprises operating a hydraulic pump at a constant speed to pump the hydraulic fluid to the cylinder. The step of determining when the hydraulic piston reaches the end position comprises measuring the time that the hydraulic pump is operated for each piston stroke, and determining that the piston has reached the end of a piston stroke when the time exceeds a predetermined value.

A number of preferred methods are described. The method that is preferred for a given application depends upon the machinery that is being actuated by the hydraulic drive system. That is, the preferred method depends upon whether the machinery is driven at a constant speed or a variable speed, and if at a variable speed, other factors may include whether the transitions between different speeds are quick or gradual. Other factors may include whether the hydraulic actuator does work in both directions or in only one direction. A common feature of all of the methods is that the steps of determining when the piston is at the end of a piston stroke and commanding the hydraulic fluid flow direction to reverse is independent from stopping piston travel by actuation of the shuttle valve.

The method can further comprise incorporating a safety factor in the determination of when the hydraulic piston reaches the end position so that there is a delay between the time when it is determined that the piston has reached the end of the piston stroke and the time when the electronic signal is sent to the flow switching device. The safety factor can be changed depending upon the direction of hydraulic piston movement if hydraulic fluid pressure within the cylinder is dependent upon the direction of hydraulic piston movement, whereby the delay can be made longer if the hydraulic fluid pressure is higher. The method can further comprise monitoring hydraulic fluid pressure and changing the safety factor to increase the delay from a predetermined baseline if there is an increase in the hydraulic fluid pressure from a predetermined baseline pressure. As already noted, it is desirable to keep the delay short to reduce the amount of energy that is wasted, but an advantage of the present method is that the open shuttle valve prevents over-pressurization of the system and allows some leeway in setting the timing for reversing hydraulic fluid flow and this enables the present system to be simplified compared to conventional hydraulic systems.

In systems in which a hydraulic pump is directly coupled to an engine, there can be times when the engine is running but the hydraulic drive system is not required. For such conditions the method can comprise continuing to pump the hydraulic fluid from the hydraulic pump, and stopping the movement of the hydraulic piston by selectively commanding the flow switching device to an idle position whereby the hydraulic fluid by-passes the cylinder and is recycled from the hydraulic pump to a hydraulic fluid reservoir. The method can further comprise commanding the flow switching device to the idle position only when the piston has reached the end of a piston stroke. If the flow switching device is a four-way two-position spool valve, the same result can be achieved by stopping the piston at the end of a piston stroke and not reversing hydraulic fluid flow until the hydraulic drive system is needed; with the piston at the end position hydraulic fluid is pumped through the cylinder and returned to the hydraulic fluid reservoir while the hydraulic piston is stationary. When the hydraulic pump is directly coupled to the engine, for example with a drive belt and pulleys, the method can further comprise determining hydraulic pump speed based upon engine speed.

The preferred method further comprises programming an electronic controller to perform the steps of determining when the hydraulic piston reaches the end position and sending an electronic signal to the flow switching device.

If the hydraulic pump is driven by a motor dedicated to the hydraulic drive system, the method can further comprise commanding the hydraulic pump to operate at a constant speed or at a speed that is based upon an input signal from a machine that is driven by the hydraulic drive system.

BRIEF DESCRIPTION OF THE DRAWINGS

In FIG. 2A the hydraulic piston is moving from right to left and approaching the cylinder head. The stem of a shuttle valve member is just contacting the cylinder head, but the shuttle valve member is still seated in the closed position. In FIG. 2B the hydraulic piston has moved closer to the cylinder head and the shuttle valve member has become unseated from its closed position, allowing hydraulic fluid to flow through the shuttle valve from the right hydraulic fluid chamber to the left hydraulic fluid chamber, neutralizing the differential pressure acting on the hydraulic piston and halting its movement. In FIG. 2C, the direction of hydraulic fluid flow has been reversed and the shuttle valve member is seated in a closed position so the hydraulic piston can move from left to right.

FIG. 3A shows the shuttle valve member in an open position, showing the sealing surfaces of the shuttle valve member and the valve seats. FIGS. 3B and 3C are end views of two different embodiments of a shuttle valve member showing guides or edges that center its position and flat sides or grooves for allowing hydraulic fluid to flow in an axial direction perpendicular to the illustrated end views.

FIGS. 7A and 7D show the pressure profiles for the hydraulic fluid chambers on opposite sides of the hydraulic piston, showing how one chamber is pressurized when it is being filled with hydraulic fluid while the other chamber is at drain pressure when hydraulic fluid is being expelled from the hydraulic fluid chamber. FIG. 7C shows the hydraulic fluid pressure downstream from the hydraulic pump but before it flows to the flow switching device, for the same example plotted in FIGS. 7A and 7B. FIG. 7D is an alternative embodiment that shows a pressure profile for a system that encounters different resistance for the retraction and extension strokes. An example of an application that would produce a pressure profile like the one in FIG. 7D would be a single acting pump, which only pumps when the actuator is moving in one direction, and the actuator encounters much less resistance when the pump piston is moving in a direction in which the pump is only drawing fluid into the pump chamber.

DETAILED DESCRIPTION OF PREFERRED EMBODIMENT(S)

In the figures described herein, like reference numbers are employed to identify like features, and to be concise, if features described with respect to one figure are shown again and identified by the same reference number in another figure, the description of such features may not be repeated.

Figure 1:
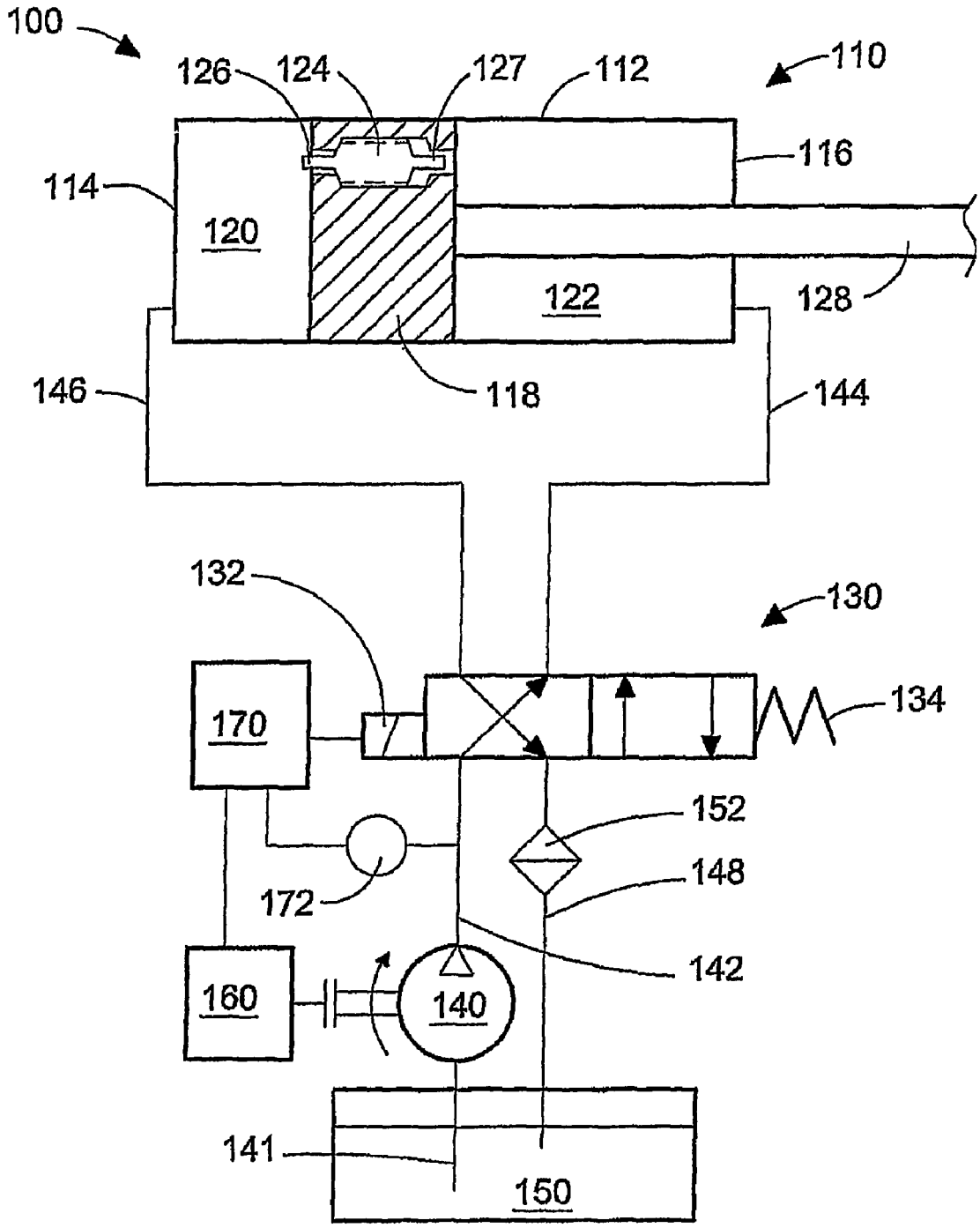
FIG. 1 shows a schematic view of a simplified hydraulic drive system with a reciprocating hydraulic actuator.

FIG. 1 is a schematic view of hydraulic drive system 100, which is operable to provide linear actuation to a machine (not shown). As noted above, there are many applications for hydraulic drive system 100, which has as its major components, hydraulic piston actuator 110, flow switching device 130, hydraulic pump 140, hydraulic fluid reservoir 150, motor 160, and electronic controller 170.

Hydraulic actuator 110 comprises hydraulic cylinder 112, which is sealed at each end by respective cylinder heads 114 and 116. Piston 118 is reciprocable within cylinder 112 and divides the interior of cylinder 112 into first hydraulic fluid chamber 120 and second hydraulic fluid chamber 122. Piston 118 comprises seals (not shown) to fluidly isolate first hydraulic fluid chamber 120 from second hydraulic fluid chamber 122.

A fluid passage is provided through piston 118 with flow through the fluid passage controlled by a shuttle valve comprising valve member 124. Valve member 124 is movable responsive to differential fluid pressures between first and second hydraulic fluid chambers 120 and 122. Valve member 124 is shaped with two sealing surfaces associated with opposite ends to cooperate with respective valve seats to seal the fluid passage when the shuttle valve is closed. Valve member 124 is urged against one of the valve seats when there is a differential pressure between the first and second hydraulic fluid chambers. In the illustrated example, when the fluid pressure is greater in hydraulic fluid chamber 122, valve member 124 is urged in the direction of hydraulic fluid chamber 120 towards a valve seat that is closer to that chamber, and when the pressure is greater in hydraulic fluid chamber 120, valve member 124 slides in the opposite direction towards hydraulic fluid chamber 122 until it is seated against a valve seat that is closer to that chamber.

Valve member 124 comprises stems 126 and 127 extending from each end of valve member 124. When, valve member 124 is seated as shown in FIG. 1, stem 126 extends through a fluid passage opening into hydraulic fluid chamber 120. When, for example, piston 124 moves from right to left and approaches cylinder head 114, stem 126 contacts cylinder head 114 before piston 118. Cylinder head 114 stops movement of valve member 124 while piston 118 continues to move towards cylinder head 114, causing valve member 124 to be lifted from the valve seat, thereby moving valve member 124 to an intermediate open position between the two valve seats, so that hydraulic fluid can flow through the shuttle valve from hydraulic fluid chamber 122 to hydraulic fluid chamber 120. This flow between the first and second hydraulic fluid chambers 120 and 122 eliminates the differential pressure acting on piston 118 causing it to stop moving.

Hydraulic actuator 110 further comprises piston rod 128. One end of piston rod 128 is connected to piston 118. Piston rod 128 extends through an opening in cylinder head 116, and another end of piston rod 128 is connectable to the machine that is actuated by hydraulic drive system 100. Some actuators may comprise two piston rods, so that a second piston rod (not shown) extends from piston 118 through an opening in cylinder head 114. Such a two-rod embodiment is within the scope of the present invention since the disclosed hydraulic drive system would operate in essentially the same way.

Flow switching device 130 controls the direction of hydraulic fluid flow to hydraulic actuator 110. The flow switching device can comprise a plurality of two way valves actuatable on the command of electronic signals from controller 170, or, as shown in the example illustrated by FIG. 1, in a preferred embodiment flow switching device 130 can be a four-way spool valve that is biased by spring 134 in a first position and actuatable by solenoid valve 132 to a second position. The direction of hydraulic fluid flow to and from hydraulic actuator 110 is reversed by switching the spool valve between the first and second positions. Solenoid 132 is operable by electronic command signals sent from controller 170.

Hydraulic pump 140 is operable to pump hydraulic fluid from reservoir 150 through low-pressure conduit 141 and high-pressure conduit 142 to an inlet into flow switching device 130. Flow switching device 130 comprises respective fluid couplings for connecting to high-pressure conduits 144 and 146 that convey hydraulic fluid between flow switching device 130 and first and second hydraulic fluid chambers 120 and 122. Depending upon the position of the spool member in flow switching device 130, one of high-pressure conduits 144 and 146 serves to deliver hydraulic fluid to hydraulic actuator 110 while the other one drains hydraulic fluid therefrom. Accordingly, while high-pressure conduits 144 and 146 sometimes convey hydraulic fluid at drain pressure, they must be suitable for conveying hydraulic fluid that is being pumped at high pressure from the discharge of hydraulic pump 140. In the example of FIG. 1, hydraulic fluid is being delivered through high-pressure conduit 144 to hydraulic fluid chamber 122 while hydraulic fluid is being drained from hydraulic fluid chamber 120 through high-pressure conduit 146.

Hydraulic fluid that is drained from hydraulic actuator 110 is returned to reservoir 150 through low-pressure conduit 148. Optional filter 152 is shown in low-pressure conduit 148, but filter 152 could also be integrated, into reservoir 150.

Motor 160 can be any type of motor for driving hydraulic pump 140, which is typically driven by a rotating movement. Suitable examples for hydraulic pump 140 include a vane pump, a gear pump, a swashplate pump, a diaphragm pump or a parastaltic pump. For example, motor 160 can be an internal combustion engine or an electric motor and hydraulic pump 140 can be directly coupled to motor 160 or a clutch can be employed to decouple hydraulic pump 140 if motor 160 drives other machines and hydraulic pump 140 is only operated on an as-needed basis. In some embodiments motor 160 comprises a speed sensor that sends a signal to controller 170 to indicate motor speed, which can be correlated to hydraulic pump speed.

Pressure sensor 172 is optional and can be used by some embodiments to send signals to controller 170 that are used to determine the timing for sending command signals to flow switching device 130. In FIG. 1, pressure sensor 172 is shown associated with high-pressure conduit 142 between the discharge of hydraulic pump 140 and flow switching device 130. In other embodiments, pressure sensors could be associated with high-pressure conduits 144 and 146 to send signals indicative of the pressure within respective second and first hydraulic fluid chambers 122 and 120.

Figure 2A:
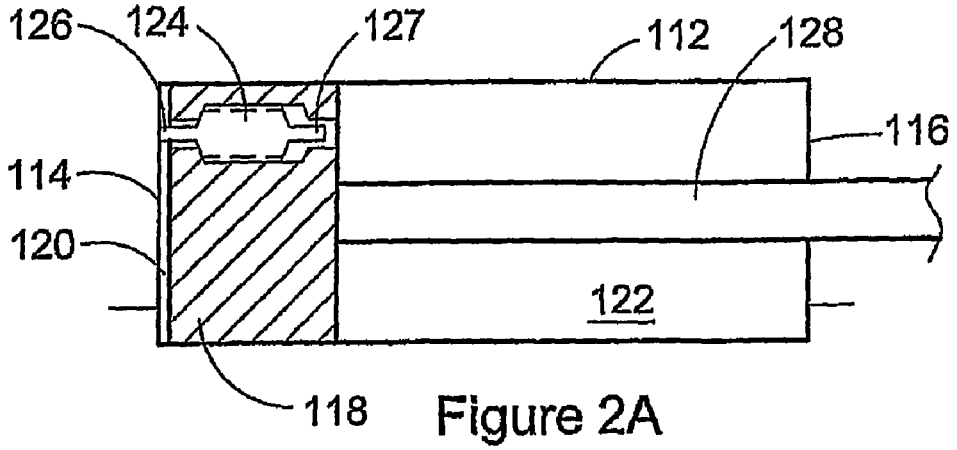
FIGS. 2A, 2B and 2C show section views of a reciprocating hydraulic actuator showing in sequence a number of views when the piston is approaching the cylinder head and reversing direction.
Figure 2B:
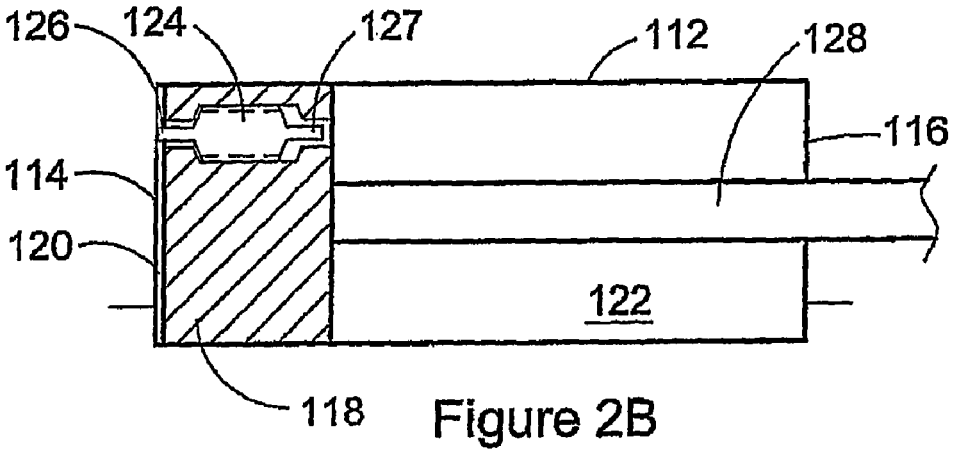
Figure 2C:
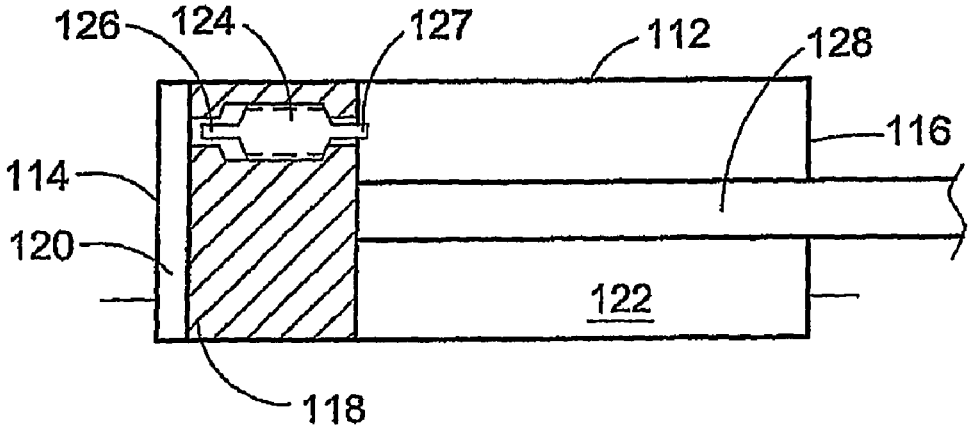

The operation of hydraulic actuator 110 is further described with reference to FIG. 1 and FIGS. 2A, 2B and 2C. FIGS. 2A, 2B and 2C illustrate a sequential view of a continuation of the piston stroke begun in FIG. 1. In FIG. 1, flow switching device 130 has its spool member in a position whereby hydraulic fluid is being pumped to second hydraulic fluid chamber 122 and hydraulic fluid is being drained from first hydraulic fluid chamber 120. This flow direction results in a differential fluid pressure that acts on hydraulic piston 118 to cause it to move from right to left, increasing the volume of second hydraulic fluid chamber 122 while the volume of first hydraulic fluid chamber 120 decreases. In FIG. 2A hydraulic piston 118 is approaching cylinder head 114. The length of stem 126 determines when shuttle valve member 124 is lifted from its seated position. In FIG. 2A, stem 126 is just making contact with cylinder head 114 and shuttle valve member 124 is still seated so that second hydraulic fluid chamber 122 is still fluidly isolated from first hydraulic fluid chamber 120. In FIG. 2B, shuttle valve member 124 is stopped against cylinder head 114 while piston 118 has continued to move towards cylinder head 114. Shuttle valve member 124 is lifted from its seated position and hydraulic fluid can flow from second hydraulic fluid chamber 122 to first hydraulic fluid chamber 120. When the shuttle valve opens, the differential pressure across hydraulic piston 118 is cancelled and so hydraulic piston 118 stops moving, marking the end of the piston stroke. Because first hydraulic fluid chamber 120 is open to drain, the hydraulic fluid can flow through hydraulic cylinder 112 so that excessive fluid pressure at the end of the piston stroke is avoided and there is no need for a pressure relief valve, which is typically required with a conventional hydraulic actuator. The method of commanding flow switching device 130 to reverse the direction of hydraulic fluid flow is described with reference to FIGS. 5 and 6. FIG. 2C shows hydraulic actuator 110 with hydraulic piston 118 moving from left to right with hydraulic fluid being pumped into first hydraulic fluid chamber 120 and hydraulic fluid being drained from second hydraulic fluid chamber 122. The differential pressure caused by the reversed direction of hydraulic fluid flow has pushed shuttle valve member 124 from left to right to seat in a second closed position, as shown in FIG. 2C. Stem 127 extends through an opening and into second hydraulic fluid chamber 122, where it is ready to contact cylinder head 116 when hydraulic piston 118 approaches it.

Figure 3A:
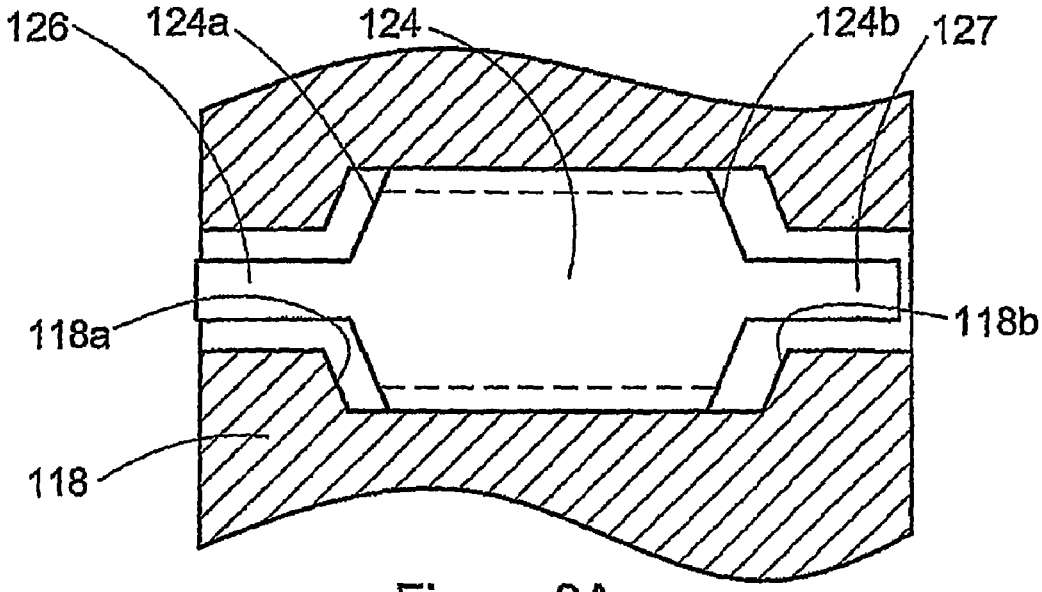
FIGS. 3A, 3B and 3C show enlarged views of the shuttle valve member.

FIG. 3A is an enlarged view of the shuttle valve shown in FIGS. 1 and 2A, 2B and 2C. FIG. 3A provides a better view of the two valve seat areas 118*a* and 118*b*, which cooperate with sealing surfaces 124*a* and 124*b* of valve member 124. When hydraulic piston 118 is moving from left to right, fluid pressure acts on valve member 124 to urge sealing surface 124*b* against valve seat 118*b*, and when hydraulic piston 118 is moving from right to left, hydraulic fluid pressure acts on valve member 124 to urge sealing surface 124*a* against valve seat 118*a*. The dashed lines indicate grooves or flat edges in the body of valve member 124, as shown in the end views of FIGS. 3B and 3C, that provide openings to allow hydraulic fluid to flow through hydraulic piston 118 when valve member 124 is in an open position, as shown in FIG. 3A.

Figure 3B:
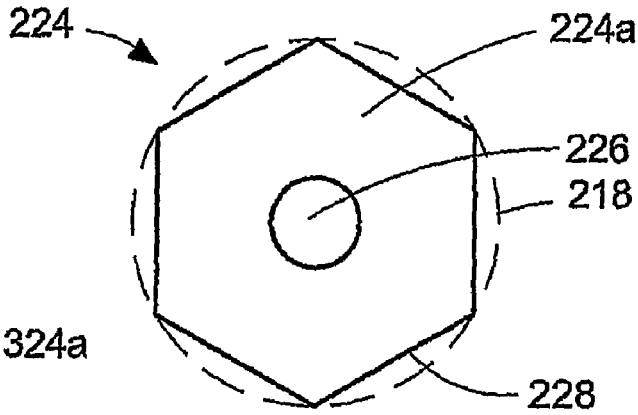
Figure 3C:
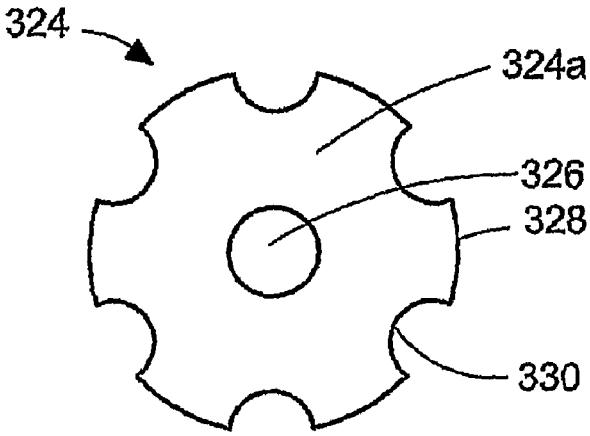

FIGS. 3B and 3C are end views that show two different examples of cross sectional shapes of a valve member that could be employed in the shuttle valve of the disclosed embodiments. In the embodiment of FIG. 3B, valve member 224 has a hexagonal cross section. Dashed line 218 shows the circular shape of the cylindrical chamber within which valve member 224 slides to serve as a shuttle valve. Sealing surface 224*a* is smooth to provide a fluid tight seal when it is urged against a cooperatively shaped valve seat. When valve member 224 is in an open position, with the sealing surfaces at each end spaced apart from the respective valve seats, hydraulic fluid can flow through the shuttle valve by flowing through the gaps between flat side surfaces 228 and the cylindrical wall shown by dashed line 218.

Valve stem 226 extends from the end of valve member 224 in an axial direction, perpendicular to the end view shown in FIG. 3B.

With reference to FIG. 3C, valve member 324 comprises a body that is substantially cylindrical so that the end view is generally round. Sealing surface 324*a* can be sloped to cooperate with a seat provided by the piston (not shown in this view). Stem 326 extends from the end of valve member 324 in an axial direction, perpendicular to the end view shown in FIG. 3C. The cylindrical body has sides 328 that help to guide the movement of valve member 324 in the axial direction. In the illustrated example, grooves 330 are provided in the sides of the cylindrical body to allow hydraulic fluid to flow between the first and second hydraulic fluid chambers and through the hydraulic piston when valve member 324 is in an open position as shown, for example, in FIG. 3A. Persons familiar with the technology involved here will understand that other cross sectional shapes are also possible without departing from the scope of the present disclosure, to function in substantially the same way and to provide substantially the same result.

Figure 4:
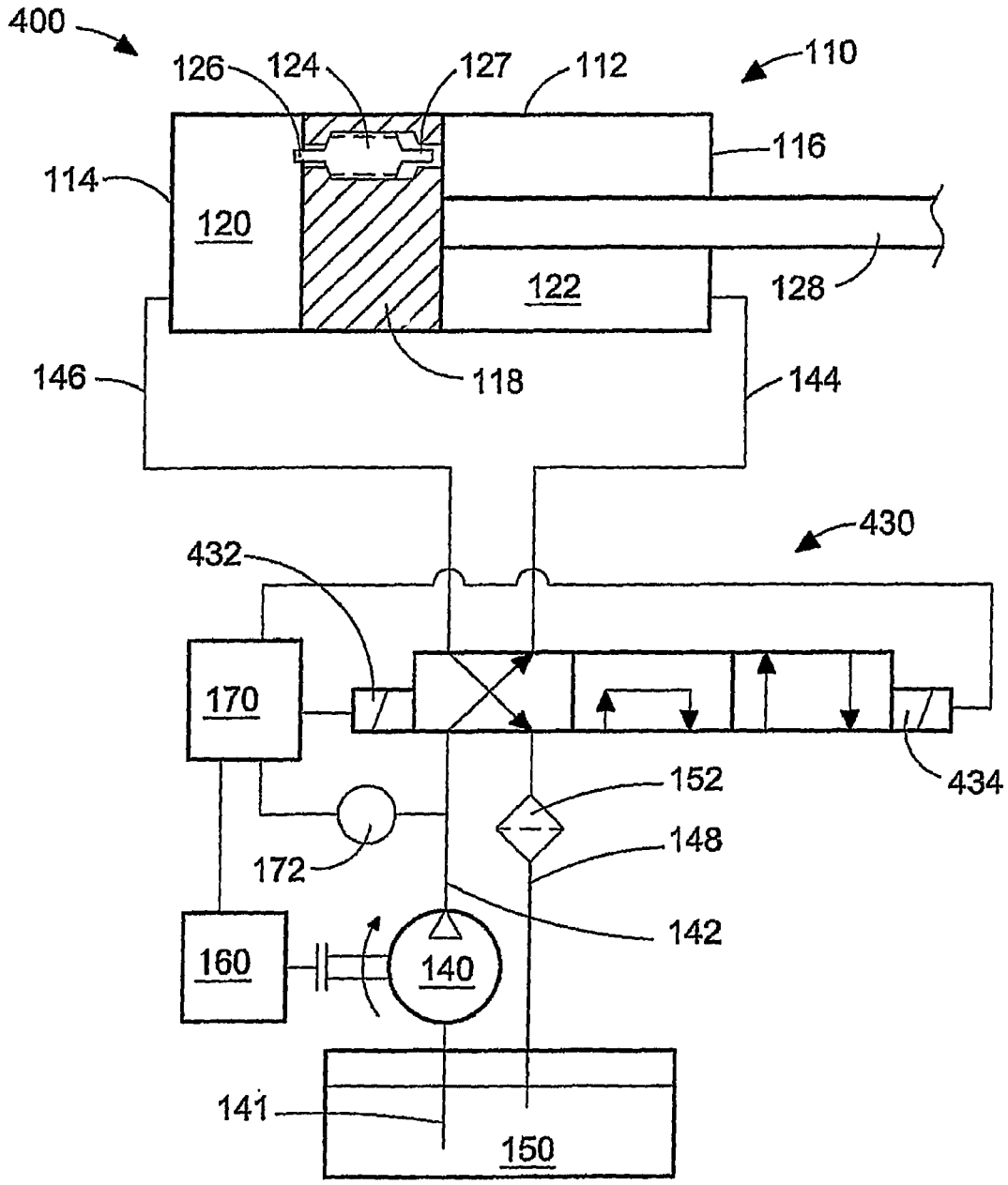
FIG. 4 shows a schematic view of another embodiment of a hydraulic drive system with a reciprocating hydraulic actuator.

FIG. 4 shows hydraulic drive system 400, which is another preferred embodiment. The embodiment of FIG. 4 is particularly advantageous when hydraulic pump 140 is directly coupled to motor 160 and motor 160 is also employed to drive other machines. In such an arrangement, there may be times when motor 160 is operating and the hydraulic drive system is not needed. Flow switching device 430 is a four-way, three-position spool valve, with the additional third position providing a flow path for recycling the hydraulic fluid and bypassing hydraulic actuator 110. Flow switching device 430 is operable responsive to command signals sent from controller 170 to two solenoid actuators 432 and 434. All other aspects of this embodiment are the same as the embodiment of FIG. 1.

Figure 5:
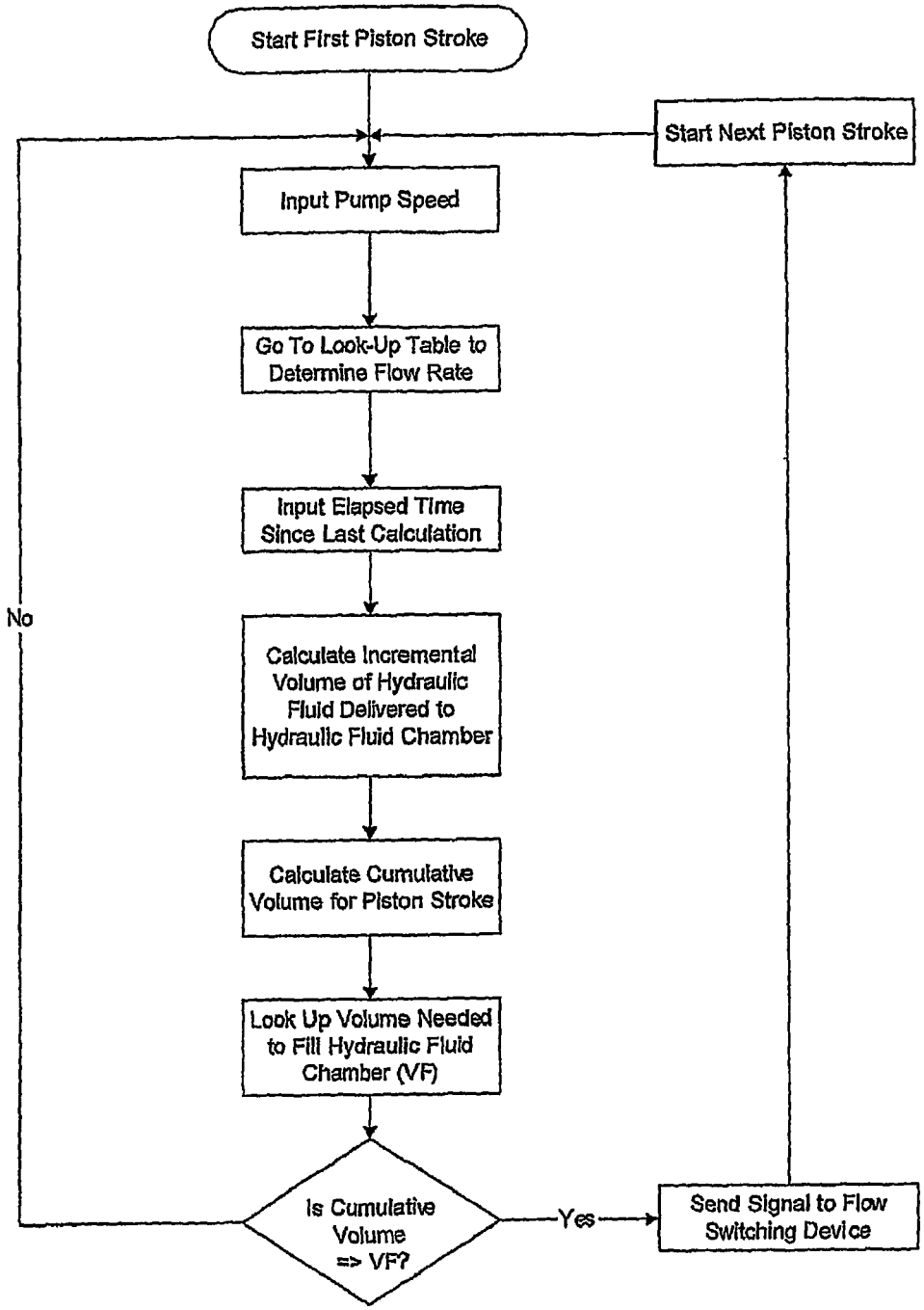
FIG. 5 is a flow diagram that illustrates a control method for commanding when to reverse the direction of hydraulic fluid flow.
Figure 6:
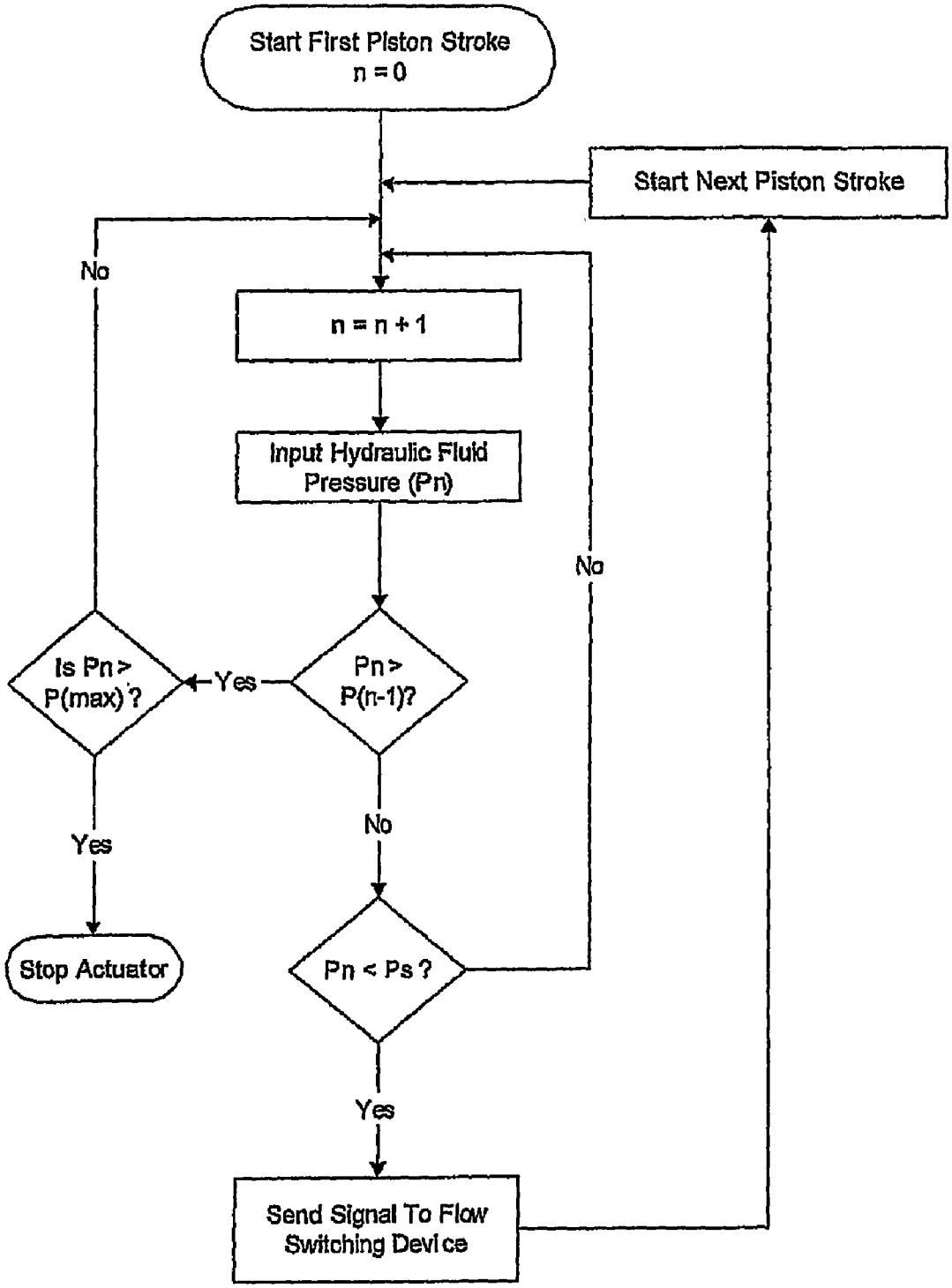
FIG. 6 is a flow diagram that illustrates another control method for commanding when to reverse the direction of hydraulic fluid flow.

The shuttle valve acts to stop the hydraulic piston at the end of each piston stroke. In order to reverse the direction of hydraulic fluid flow, controller 170 sends an electronic signal to the flow switching device to command it to actuate one or more valves to switch the connections to the respective conduits from pressure to drain and vice versa. Controller 170 in the described embodiments is programmable to determine when the piston has reached the end of each piston stroke based upon at least one of hydraulic pump speed, hydraulic fluid pressure, or elapsed time. The information that is used by controller 170 to make this determination is measured during each piston stroke. FIGS. 5 and 6 are flow diagrams that illustrate methods that can be employed by controller 170 to determine when the hydraulic piston has reached the end of a piston stroke.

FIG. 5 illustrates a method whereby pump speed is used to determine when a piston stroke is completed. The program starts with the first piston stroke when the hydraulic drive system is activated. The program goes through the illustrated loop at predetermined time intervals. For example, this loop could begin at a predetermined time interval selected between 1 and 100 milliseconds. The length of the predetermined time interval depends upon the accuracy and efficiency required by the hydraulic drive system. For example, for operating a reciprocating cryogenic piston pump a predetermined interval time selected in a range of between 30 and 50 milliseconds can be suitable. At the first step in the loop, hydraulic pump speed is inputted to the controller. The hydraulic pump speed could be determined from motor speed or a speed sensor provided on the hydraulic pump itself. The next step is for the controller to go to a look-up table to determine flow rate. From the inputted hydraulic pump the controller can determine from the look-up table the fluid flow rate. In the next step, the controller determined the elapsed time since the last calculation, which is the time interval between loops. Then the controller can calculate the incremental volume of hydraulic fluid pumped to the hydraulic fluid chamber that is being filled, and also the cumulative volume of hydraulic fluid that has been pumped during the current piston stroke. The controller can look up the volume needed to fill the hydraulic fluid chamber (VF), since this volume is normally different for opposite strokes since the piston rod occupies some of the volume of the chamber through which it extends. If the controller determines that the cumulative volume is less than VF, then the controller repeats the loop until the cumulative volume is equal to or greater than VF. When the cumulative volume is equal to or greater than VF the controller determines that the hydraulic piston is at the end of its piston stroke and the controller sends an electronic signal to the flow switching device to actuate it and reverse the direction of hydraulic fluid flow, starting the next piston stroke.

Accordingly, the method illustrated by FIG. 5 can be used by hydraulic drive systems with variable speed control of the hydraulic pump because the method monitors hydraulic pump speed at predetermined time intervals and factors this into its calculations to determine when the hydraulic piston has completed a piston stroke. In a simpler system in which the hydraulic pump is always operated at a constant speed a few steps can be eliminated from this method. That is, since pump speed is known, the controller only needs to measure elapsed time and since the displaced volume of the hydraulic fluid chambers is constant the controller knows when the piston has reached the end of each piston stroke when a predetermined elapsed time has been measured. When the predetermined elapsed time has transpired, the controller can be programmed to send an electronic signal to the flow switching device and to begin measuring elapsed time for the next piston stroke.

FIG. 6 illustrates another preferred method for determining when the piston reaches the end of each piston stroke. When the shuttle valve opens at the end of each piston stroke, there is a substantial decrease in the hydraulic fluid pressure since the hydraulic fluid is simply flowing through the hydraulic actuator. Some examples of pressure profiles are discussed later with reference to FIGS. 7A, 7B, 7C and 7D. Referring now to the method shown in FIG. 6, the program begins with the start of the first piston stroke when the hydraulic drive system is activated. A counter counts the number of times the control loop is completed by setting $n=n+1$. A pressure sensor sends a signal to the controller to input hydraulic fluid pressure (Pn). The controller checks if the hydraulic fluid pressure is higher than the last measurement by determining if $Pn>P(n-1)$. At the beginning of a piston stroke the hydraulic fluid pressure increases from drain pressure to a predetermined drive pressure, which is based upon the design of the system and the selected hydraulic pump. If Pn is greater than $P(n-1)$ then the controller checks to make sure that Pn is not greater than a predetermined maximum system pressure P(max). If Pn is greater than P(max) then the controller stops the actuator. This could occur, for example if the machine being driven by the actuator is jammed and won't move. If Pn is greater than $P(n-1)$ and less than P(max) then the actuator is functioning normally and the controller repeats the loop at a predetermined time interval. When Pn is less than $P(n-1)$ this could indicate that the hydraulic piston has reached the end of a piston stroke and the shuttle valve is open so hydraulic fluid pressure in the system decreases substantially. Ps is a predetermined value that indicates that hydraulic fluid pressure has dropped a substantial amount indicating that the shuttle valve is open and that it is time to reverse the direction of hydraulic fluid flow by actuating the flow switching device. If Pn is not less than Ps the controller repeats the loop at another predetermined time interval. If Pn is less than Ps, the controller sends an electronic signal to the flow switching device to start the next piston stroke.

With the method illustrated by FIG. 6, the value for Ps can be determined from a look-up table, where Ps is a function of hydraulic fluid flow rate, which can be calculated from hydraulic pump speed as described with respect to the method shown by FIG. 5. The fixed flow area through the shuttle valve determines a known pressure drop for a given fluid flow rate, so by adjusting the value of threshold pressure Ps as a function of flow rate, the controller can more precisely determine when the shuttle valve is open and the hydraulic piston is at the end of a piston stroke.

Figure 7A:
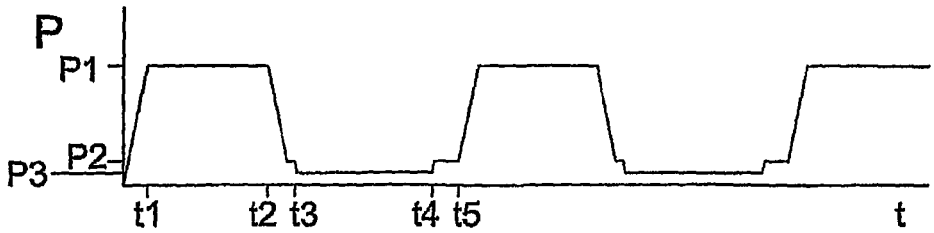
FIGS. 7A, 7B, 7C and 7D are plots of pressure versus time, illustrating the pressure between the flow switching valve and each of the hydraulic piston actuator chambers, showing the pressure profile over a few piston strokes.
Figure 7B:
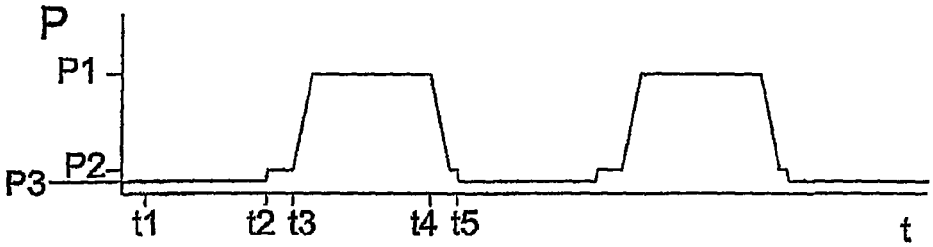
Figure 7C:
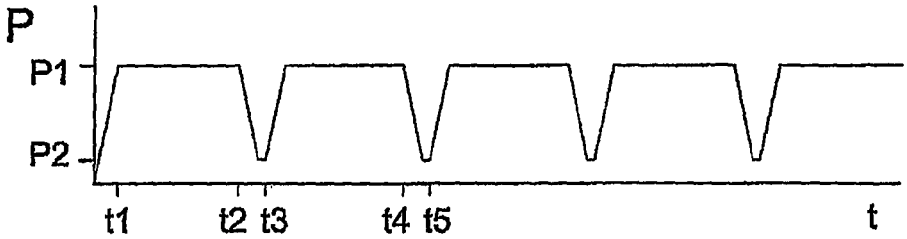

FIGS. 7A, 7B, 7C and 7D illustrate a number of different pressure profiles that plot hydraulic fluid pressure against time to further explain the method illustrated by FIG. 6. FIGS. 7A, 7B and 7C could be pressure profiles for the same hydraulic drive system with FIGS. 7A and 7B illustrating the hydraulic fluid pressure in respective first and second hydraulic fluid chambers and FIG. 7C showing the hydraulic fluid pressure in a conduit between the hydraulic pump discharge and the flow switching device, which is the location of the pressure sensor shown in FIGS. 1 and 4.

Referring now to FIG. 7A, when the hydraulic drive system is first activated, hydraulic fluid pressure rises until time t 1 when pressure reaches drive pressure P1, where it remains substantially constant until time t2, when the shuttle valve opens. At t2 hydraulic fluid pressure begins to quickly decreases to pressure P2. According to the method illustrated by FIG. 6, the controller detects when pressure decreases to P2 by determining that pressure is less than predetermined threshold pressure Ps. Because the pressure drop is so substantial, relatively inexpensive pressure sensors can be employed since the pressure sensors can detect such a substantial drop in pressure without needing to be very accurate. At time t3, the controller actuates the flow switching device and the shuttle valve closes allowing the pressure in the first hydraulic fluid chamber to drop to drain pressure P3 while hydraulic fluid is drained from the first hydraulic fluid chamber. At time t4, the shuttle valve opens when the piston reaches the end of the next piston stroke and pressure rises in the first hydraulic fluid chamber to pressure P2 as hydraulic fluid again flows through the open shuttle valve and through the hydraulic cylinder. At time t5 the controller sends a command signal to the flow switching device to reverse the direction of hydraulic fluid flow, which causes the shuttle valve to close. Then the pressure in the first hydraulic fluid chamber quickly rises again to drive pressure P1 to being another piston stroke.

The pressure profile shown by FIG. 7B follows the same pattern as the pressure profile shown by FIG. 7A, except with an offset because the pressure in the second hydraulic fluid chamber is at drain pressure when the pressure in the first hydraulic fluid chamber is at drive pressure, and vice versa. Accordingly, at time t1, while the first hydraulic fluid chamber is being filled with hydraulic fluid at drive pressure, hydraulic fluid in the second hydraulic fluid chamber is at drain pressure P3. At time t2, when the shuttle valve is open, pressure in the second hydraulic fluid chamber increases to pressure P2 while the hydraulic fluid is flowing through the hydraulic piston. At time t3 the controller sends a signal to actuate the flow switching device and the shuttle valve closes and pressure quickly rises in the second hydraulic fluid chamber. At t4 the hydraulic piston has reached the end of the next piston stroke and the shuttle valve opens so that pressure within the second hydraulic fluid chamber begins to quickly decrease to pressure P2. At time t5 the controller again sends an electronic signal to command the flow switching device to reverse the direction of hydraulic fluid flow, whereupon the shuttle valve again closes and pressure within the second hydraulic fluid chamber drops to drain pressure since the conduit from that chamber is connected to the drain system.

FIG. 7C shows the pressure profile that would be measured by a pressure sensor associated with the high-pressure conduit connecting the hydraulic pump discharge to the flow switching device, as shown in FIGS. 1 and 4. The pressure profile of FIG. 7 represents a merging of the pressure profiles of FIGS. 7A and 7B. At time t1 the first hydraulic fluid chamber is being filled with hydraulic fluid and pressure has risen to drive pressure P1. At time t2 the shuttle valve has opened and pressure in the first hydraulic fluid chamber begins to decrease sharply to pressure P2, while hydraulic fluid flows through the hydraulic piston. Threshold pressure Ps can be set to be between P1 and P2, but closer to P2. The controller detects this decrease in fluid pressure when pressure drops below pressure Ps. At time t3 the controller sends an electronic signal to command the flow switching device to reverse the direction of hydraulic fluid flow and pressure quickly increases after the shuttle valve closes and the second hydraulic fluid chamber is filled with hydraulic fluid. At time t4, the shuttle valve opens again and the pressure in the second hydraulic fluid chamber begins to quickly drop to pressure P2 while hydraulic fluid flows through the hydraulic piston at the end of the piston stroke. At time t5 the controller again sends an electronic signal to command the flow switching device to reverse the direction of hydraulic fluid flow, causing the shuttle valve to close and the pressure in the first hydraulic fluid chamber rises again to pressure P1.

Figure 7D:
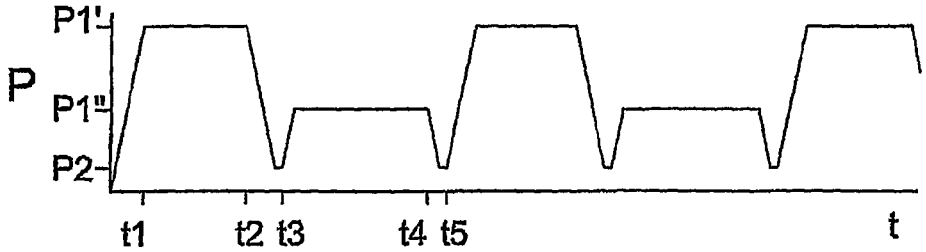

In the example of FIGS. 7A, 7B and 7C the drive pressure P1 is the same when the hydraulic piston is traveling in both directions. This would be the case for many machines such as double acting pumps or hydraulic actuators that have two piston rods. However, with other machines, such as single acting pumps or lifting machines, the drive pressure, which is a function of the machine's resistance to actuation, is different depending upon the direction of actuation. FIG. 7D shows a pressure profile in which the drive pressure in one direction (P1') is different from the drive pressure in the opposite direction (P1"). Because the pressure drop when the fluid is flowing through piston is still substantial at the end of each piston stroke, the method illustrated by FIG. 6 could still be used as long as threshold pressure Ps is between drive pressure P1" and P2 and preferable closer to P2. In FIG. 7D, times t1, t2, t3, t4 and t5 mark the same events that are shown by the same reference times shown in FIG. 7C but the drive pressure changes depending upon the direction of hydraulic piston travel.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A hydraulic drive system comprising components that cooperate with one another to deliver reciprocating motion and to provide piston strokes of consistent length in each actuation stroke, said system comprising:

(a) an actuator comprising a piston disposed within a cylinder and reciprocable between two cylinder heads in each actuation stroke, whereby said piston divides said cylinder into respective first and second hydraulic fluid chambers and a piston stroke is defined by said piston traveling from a first predetermined position near one of said cylinder heads to a second predetermined position near the other one of said cylinder heads;

(b) at least one piston rod comprising a first end connected to said piston and a second end extending through one of said two cylinder heads and out of said cylinder;

(c) a flow switching device comprising a flow switching member that is actuatable between at least two positions by an actuator that is activatable by an electronic signal to reverse the direction of hydraulic fluid flow to or from said first and second hydraulic fluid chambers so that hydraulic fluid flows into one of said first or second hydraulic fluid chambers when hydraulic fluid is flowing out of the other one of said first or second hydraulic fluid chambers;

(d) a hydraulic pump comprising a discharge outlet and a suction inlet;

(e) high pressure conduits for respective fluid connections between each one of said first and second hydraulic fluid chambers and respective fluid couplings of said flow switching device, and between an inlet of said flow switching device and said discharge outlet;

(f) low pressure conduits for connecting an outlet of said flow switching device to a hydraulic fluid reservoir and said hydraulic fluid reservoir to said suction inlet, or for connecting said outlet of said flow switching device directly to said suction inlet;

(g) a shuttle valve and a fluid passage through said piston wherein said shuttle valve is operable to close said fluid passage when said piston is moving during one of said piston strokes, and to open said fluid passage when said piston is at the end of one of said piston strokes; and (h) a controller that is programmed to:

determine when said piston has reached the end of each piston stroke based upon at least one of hydraulic pump speed, hydraulic fluid pressure, or elapsed time, all measured during each piston stroke; and send an electronic signal to said flow switching device to command said flow switching member to be actuated from one position to another position to reverse the hydraulic fluid flow when said controller determines that said piston has reached the end of each piston stroke.

2. The hydraulic drive system of claim 1 wherein said controller is configured to receive a signal indicative of hydraulic pump speed and is programmed to:

determine hydraulic fluid flow rate based upon hydraulic pump speed by referencing a look-up table that indicates hydraulic fluid flow rates corresponding to respective pump speeds;

measure the elapsed time for each piston stroke;

calculate the volume of hydraulic fluid that has flowed into the one of said first and second hydraulic fluid chambers into which hydraulic fluid is flowing; and determine when said piston has reached the end of a piston stroke by determining when said calculated volume is equal to or greater than a known volume that is required to fill the one of said first and second hydraulic fluid chambers into which hydraulic fluid is flowing.

3. The hydraulic drive system of claim 1 wherein said hydraulic pump is operable at a constant speed and said controller is programmed to determine when said piston has reached the end of each piston stroke by measuring the elapsed time for each piston stroke, and determining that said piston has reached the end of a piston stroke when said hydraulic pump has operated for a predetermined time, measured from the beginning of each piston stroke.

4. The hydraulic drive system of claim 1 wherein said flow switching device comprises at least one solenoid that can receive said electronic signal from said controller, and wherein said solenoid is operable to actuate said flow switching member.

5. The hydraulic drive system of claim 4 wherein said flow switching device is a four-way two-position spool valve wherein said flow switching member comprises a spool member selectively movable to a first position wherein said first hydraulic fluid chamber is fluidly connected to receive hydraulic fluid from said hydraulic pump discharge outlet and said second hydraulic fluid chamber is fluidly connected to drain said hydraulic fluid through one of said low pressure conduits, and a second position wherein said second hydraulic fluid chamber is fluidly connected to receive hydraulic fluid from said hydraulic pump discharge outlet and said first hydraulic fluid chamber is fluidly connected to drain said hydraulic fluid through one of said low pressure conduits.

6. The hydraulic drive system of claim 4 wherein said flow switching device is a four-way three-position spool valve wherein said flow switching member comprises a spool member selectively movable to a first position wherein said first hydraulic fluid chamber is fluidly connected to receive hydraulic fluid from said hydraulic pump discharge outlet and said second hydraulic fluid chamber is fluidly connected to drain said hydraulic fluid through one of said low pressure conduits, a second position wherein said second hydraulic fluid chamber is fluidly connected to receive hydraulic fluid from said hydraulic pump discharge outlet and said first hydraulic fluid chamber is fluidly connected to drain said hydraulic fluid through one of said low pressure conduits, and a third position wherein said hydraulic pump discharge outlet is in fluid communication with one of said low pressure conduits through which hydraulic fluid is returnable to said hydraulic fluid reservoir.

7. The hydraulic drive system of claim 1 wherein said shuttle valve comprises a valve member that is movable between two closed positions and that is in an open position when said valve member is positioned between said two closed positions, wherein when said flow switching device reverses the direction of hydraulic fluid flow, said valve member is movable under the influence of a differential pressure between said first and second hydraulic fluid chambers towards the one of said first and second hydraulic fluid chambers from which hydraulic fluid is flowing to said reservoir until said valve member is seated in one of said closed positions, and said valve member is movable to an open position between said two closed positions near the end of each stroke when a stem portion of said valve member contacts one of said cylinder heads, so that further movement of said piston causes said valve member to be lifted away from one of said closed positions.

8. The hydraulic system of claim 7 wherein said valve member comprises opposite cone-shaped ends that face cooperatively shaped seating areas of said piston, and each of said cone-shaped ends has an associated stem extending therefrom and said respective stems are elongated so that they extend from said piston into the one of said first and second hydraulic fluid chambers out from which said hydraulic fluid is flowing when said valve member is seated in one of said two closed positions.

9. The hydraulic drive system of claim 1 wherein said hydraulic pump is mechanically driven by an internal combustion engine.

10. The hydraulic drive system of claim 9 wherein said controller is configured to receive a signal from an engine speed sensor from which said controller can calculate that speed of said hydraulic pump.

11. The hydraulic drive system of claim 1 wherein said controller is configured to send a command signal to said hydraulic pump to operate at a speed that is required to operate a machine operatively connected to said second end of said piston rod at a desired speed, and said speed for said hydraulic pump that is commanded by said controller is employed by the controller to calculate the end of said piston stroke.

12. The hydraulic drive system of claim 1 wherein said hydraulic fluid is held in said reservoir at atmospheric pressure.

13. A hydraulic drive system hydraulic drive system comprising components that cooperate with one another to deliver reciprocating motion and to provide piston strokes of consistent length, said system comprising:

(a) an actuator comprising a piston disposed within a cylinder and reciprocable between two cylinder heads, whereby said piston divides said cylinder into respective first and second hydraulic fluid chambers and a piston stroke is defined by said piston traveling from a first predetermined position near one of said cylinder heads to a second predetermined position near the other one of said cylinder heads;

(b) at least one piston rod comprising a first end connected to said piston and a second end extending through one of said two cylinder heads and out of said cylinder;

(c) a flow switching device comprising a flow switching member that is actuatable between at least two positions by an actuator that is activatable by an electronic signal to reverse the direction of hydraulic fluid flow to or from said first and second hydraulic fluid chambers so that hydraulic fluid flows into one of said first or second hydraulic fluid chambers when hydraulic fluid is flowing out of the other one of said first or second hydraulic fluid chambers;

(d) a hydraulic pump comprising a discharge outlet and a suction inlet;

(e) high pressure conduits for respective fluid connections between each one of said first and second hydraulic fluid chambers and respective fluid couplings of said flow switching device, and between an inlet of said flow switching device and said discharge outlet;

(f) low pressure conduits for connecting an outlet of said flow switching device to a hydraulic fluid reservoir and said hydraulic fluid reservoir to said suction inlet, or for connecting said outlet of said flow switching device directly to said suction inlet;

(g) a shuttle valve and a fluid passage through said piston wherein said shuttle valve is operable to close said fluid passage when said piston is moving during one of said piston strokes, and to open said fluid passage when said piston is at the end of one of said piston strokes; and (h) a controller that is programmed to:

determine when said piston has reached the end of each piston stroke based upon at least one of hydraulic pump speed, hydraulic fluid pressure, or elapsed time, all measured during each piston stroke; and send an electronic signal to said flow switching device to command said flow switching member to be actuated from one position to another position to reverse the hydraulic fluid flow when said controller determines that said piston has reached the end of each piston stroke, wherein said controller is configured to receive a signal indicative of hydraulic fluid pressure at a location at or between said hydraulic pump discharge and said hydraulic fluid chamber into which hydraulic fluid is flowing, and is programmed to determine when said piston has reached the end of a piston stroke by determining when said shuttle valve has opened and said hydraulic fluid pressure drops below a predetermined value.

14. A hydraulic drive system comprising components that cooperate with one another to deliver reciprocating motion and to provide piston strokes of consistent length, said system comprising:

(a) an actuator comprising a piston disposed within a cylinder and reciprocable between two cylinder heads, whereby said piston divides said cylinder into respective first and second hydraulic fluid chambers and a piston stroke is defined by said piston traveling from a first predetermined position near one of said cylinder heads to a second predetermined position near the other one of said cylinder heads;

(b) at least one piston rod comprising a first end connected to said piston and a second end extending through one of said two cylinder heads and out of said cylinder;

(c) a flow switching device comprising a flow switching member that is actuatable between at least two positions by an actuator that is activatable by an electronic signal to reverse the direction of hydraulic fluid flow to or from said first and second hydraulic fluid chambers so that hydraulic fluid flows into one of said first or second hydraulic fluid chambers when hydraulic fluid is flowing out of the other one of said first or second hydraulic fluid chambers;

(d) a hydraulic pump comprising a discharge outlet and a suction inlet;

(e) high pressure conduits for respective fluid connections between each one of said first and second hydraulic fluid chambers and respective fluid couplings of said flow switching device, and between an inlet of said flow switching device and said discharge outlet;

(f) low pressure conduits for connecting an outlet of said flow switching device to a hydraulic fluid reservoir and said hydraulic fluid reservoir to said suction inlet, or for connecting said outlet of said flow switching device directly to said suction inlet;

(g) a shuttle valve and a fluid passage through said piston wherein said shuttle valve is operable to close said fluid passage when said piston is moving during one of said piston strokes, and to open said fluid passage when said piston is at the end of one of said piston strokes; and (h) a controller that is programmed to:

determine when said piston has reached the end of each piston stroke based upon at least one of hydraulic pump speed, hydraulic fluid pressure, or elapsed time, all measured during each piston stroke; and send an electronic signal to said flow switching device to command said flow switching member to be actuated from one position to another position to reverse the hydraulic fluid flow when said controller determines that said piston has reached the end of each piston stroke, wherein said controller adds a predetermined delay to the timing for sending said electronic signal to said flow switching device so that said piston is stationary for at least a predetermined time between each piston stroke.

15. A hydraulic drive system comprising components that cooperate with one another to deliver reciprocating motion and to provide piston strokes of consistent length in each actuation stroke, said system comprising:

(a) an actuator comprising a piston disposed within a cylinder and reciprocable between two cylinder heads in each actuation stroke, whereby said piston divides said cylinder into respective first and second hydraulic fluid chambers and a piston stroke is defined by said piston traveling from a first predetermined position near one of said cylinder heads to a second predetermined position near the other one of said cylinder heads;

(b) at least one piston rod comprising a first end connected to said piston and a second end extending through one of said two cylinder heads and out of said cylinder;

(c) a flow switching device comprising a flow switching member that is actuatable between at least two positions to reverse the direction of hydraulic fluid flow to or from said first and second hydraulic fluid chambers so that hydraulic fluid flows into one of said first or second hydraulic fluid chambers when hydraulic fluid is flowing out of the other one of said first or second hydraulic fluid chambers;

(d) a hydraulic pump comprising a discharge outlet and a suction inlet;

(e) high pressure conduits for respective fluid connections between each one of said first and second hydraulic fluid chambers and respective fluid couplings of said flow switching device, and between an inlet of said flow switching device and said discharge outlet;

(f) low pressure conduits for connecting an outlet of said flow switching device to a hydraulic fluid reservoir and said hydraulic fluid reservoir to said suction inlet, or for connecting said outlet of said flow switching device directly to said suction inlet; and (g) a shuttle valve and a fluid passage through said piston wherein said shuttle valve is operable to close said fluid passage when said piston is moving during one of said piston strokes and to open said fluid passage when said piston is at the end of one of said piston strokes, and wherein said shuttle valve comprises a valve member shaped with two sealing surfaces associated with opposite ends of said valve member, which is movable between two closed positions where said sealing surfaces can cooperate with respective valve seats to seal said fluid passage, said valve member being in an open position when said valve member is disposed between said two closed positions with both of said sealing surfaces spaced apart from said respective valve seats;

wherein said fluid passage and said shuttle valve are sized such that when said shuttle valve is in said open position, movement of said piston is halted.

16. The hydraulic drive system of claim 15 wherein said valve member comprises two stem portions with one stem portion extending in the direction of each one of said hydraulic fluid chambers, and when said flow switching device reverses the direction of hydraulic fluid flow, said valve member is movable under the influence of a differential pressure between said first and second hydraulic fluid chambers towards the one of said first and second hydraulic fluid chambers from which hydraulic fluid is flowing to said reservoir until said valve member is seated in one of said closed positions, and said valve member is movable to an open position between said two closed positions near the end of each piston stroke when one of said stem portions of said valve member contacts one of said cylinder heads, so that further movement of said piston causes said valve member to be lifted away from one of said closed positions.

17. The hydraulic system of claim 15 wherein said valve member comprises opposite cone-shaped ends that face cooperatively shaped seating areas of said piston, and each of said cone-shaped ends has an associated stem extending therefrom and said respective stems being elongated so that they extend from said piston into the one of said first and second hydraulic fluid chambers from which said hydraulic fluid is flowing out of when said valve member is seated in one of said two closed positions.

18. A method of operating a hydraulic drive system, said method comprising:

reciprocating a hydraulic piston within a cylinder to provide piston strokes of consistent length in each actuation stroke by reversing the direction of hydraulic fluid flow to said cylinder to alternate between:

delivering hydraulic fluid from a reservoir to a first hydraulic fluid chamber associated with one side of said hydraulic piston while draining hydraulic fluid to said reservoir from a second hydraulic fluid chamber associated with an opposite side of said hydraulic piston, and delivering hydraulic fluid from said reservoir to said second hydraulic fluid chamber while draining hydraulic fluid to said reservoir from said first hydraulic fluid chamber;

mechanically actuating a shuttle valve when said hydraulic piston is a predetermined distance from a cylinder head to fluidly connect the first hydraulic fluid chamber to said second hydraulic fluid chamber while one of said first or second hydraulic fluid chambers is fluidly connected to said reservoir, thereby halting movement of said hydraulic piston and defining an end position for a piston stroke;

determining when said hydraulic piston reaches said end position based upon measurements taken during said piston stroke of at least one of hydraulic pump speed, hydraulic fluid pressure, or elapsed time; and when it has been determined that said hydraulic piston has reached said end position, sending an electronic signal to actuate a flow switching device to reverse the hydraulic fluid flow direction, whereupon said shuttle valve closes and said hydraulic piston commences a new piston stroke, moving in a direction opposite to movement of said piston during said piston stroke just ended.

19. The method of claim 18 wherein said step of determining when said hydraulic piston reaches said end position comprises determining the speed of a hydraulic pump that pumps said hydraulic fluid to said cylinder, referencing a look-up table that indicates hydraulic fluid flow rates corresponding to pump speeds, and calculating when the volume of hydraulic fluid delivered to a hydraulic fluid chamber equals a known volume that is required to fill said first or second hydraulic fluid chamber by a respective piston stroke.

20. The method of claim 18 further comprising operating a hydraulic pump at a constant speed to pump said hydraulic fluid to said cylinder and wherein said step of determining when said hydraulic piston reaches said end position comprises measuring the time that said hydraulic pump is operated for each piston stroke, and determining that said piston has reached the end of a piston stroke when the time exceeds a predetermined value.

21. The method of claim 18 further comprising directly coupling a hydraulic pump to an engine, pumping said hydraulic fluid from said hydraulic pump to said cylinder, and stopping the movement of said hydraulic piston by selectively commanding said flow switching device to an idle position whereby said hydraulic fluid by-passes said cylinder and is recycled from said hydraulic pump to a hydraulic fluid reservoir.

22. The method of claim 21 wherein said flow switching device is commanded to said idle position only when said piston has reached the end of a piston stroke.

23. The method of claim 21 further comprising calculating hydraulic pump speed based upon engine speed.

24. The method of claim 18 wherein said flow switching device is actuated by at least one solenoid.

25. The method of claim 18 further comprising programming an electronic controller to perform the steps of determining when said hydraulic piston reaches said end position and sending an electronic signal to said flow switching device.

26. The method of claim 18 further comprising commanding the speed of a hydraulic pump that pumps hydraulic fluid to said cylinder based upon an input signal from a machine that is driven by said hydraulic drive system.

27. A method of operating a hydraulic drive system, said method comprising:

reciprocating a hydraulic piston within a cylinder by reversing the direction of hydraulic fluid flow to said cylinder to alternate between:

delivering hydraulic fluid from a reservoir to a first hydraulic fluid chamber associated with one side of said hydraulic piston while draining hydraulic fluid to said reservoir from a second hydraulic fluid chamber associated with an opposite side of said hydraulic piston, and delivering hydraulic fluid from said reservoir to said second hydraulic fluid chamber while draining hydraulic fluid to said reservoir from said first hydraulic fluid chamber;

mechanically actuating a shuttle valve when said hydraulic piston is a predetermined distance from a cylinder head to fluidly connect the first hydraulic fluid chamber to said second hydraulic fluid chamber while one of said first or second hydraulic fluid chambers is fluidly connected to said reservoir, thereby halting movement of said hydraulic piston and defining an end position for a piston stroke;

determining when said hydraulic piston reaches said end position based upon measurements taken during said piston stroke of at least one of hydraulic pump speed, hydraulic fluid pressure, or elapsed time; and when it has been determined that said hydraulic piston has reached said end position, sending an electronic signal to actuate a flow switching device to reverse the hydraulic fluid flow direction, whereupon said shuttle valve closes and said hydraulic piston commences a new piston stroke, moving in a direction opposite to movement of said piston during said piston stroke just ended, wherein said step of determining when said hydraulic piston reaches said end position comprises monitoring hydraulic fluid pressure at a location where the measured pressure correlates to pressure within the one of said first and second hydraulic fluid chambers that is being filled with hydraulic fluid, and determining that said piston is at the end of each piston stroke when the measured pressure drops below a predetermined threshold value.

28. The method of claim 27 further comprising changing said predetermined threshold value by referencing a look-up table whereby said predetermined threshold value is determined as a function of hydraulic pump speed or the direction said piston is traveling.

29. The method of claim 27 further comprising shutting down said hydraulic drive system if hydraulic fluid pressure in said first or second hydraulic fluid chambers rises above a predetermined maximum system pressure.

30. A method of operating a hydraulic drive system, said method comprising:

reciprocating a hydraulic piston within a cylinder by reversing the direction of hydraulic fluid flow to said cylinder to alternate between:

delivering hydraulic fluid from a reservoir to a first hydraulic fluid chamber associated with one side of said hydraulic piston while draining hydraulic fluid to said reservoir from a second hydraulic fluid chamber associated with an opposite side of said hydraulic piston, and delivering hydraulic fluid from said reservoir to said second hydraulic fluid chamber while draining hydraulic fluid to said reservoir from said first hydraulic fluid chamber;

mechanically actuating a shuttle valve when said hydraulic piston is a predetermined distance from a cylinder head to fluidly connect the first hydraulic fluid chamber to said second hydraulic fluid chamber while one of said first or second hydraulic fluid chambers is fluidly connected to said reservoir, thereby halting movement of said hydraulic piston and defining an end position for a piston stroke;

determining when said hydraulic piston reaches said end position based upon measurements taken during said piston stroke of at least one of hydraulic pump speed, hydraulic fluid pressure, or elapsed time; and when it has been determined that said hydraulic piston has reached said end position, sending an electronic signal to actuate a flow switching device to reverse the hydraulic fluid flow direction, whereupon said shuttle valve closes and said hydraulic piston commences a new piston stroke, moving in a direction opposite to movement of said piston during said piston stroke just ended; and incorporating a safety factor in the determination of when said hydraulic piston position reaches said end position so that there is a delay between the time when it is determined that said piston has reached the end of said piston stroke and the time when said electronic signal is sent to said flow switching device.

31. The method of claim 30 wherein said safety factor is changed depending upon the direction of hydraulic piston movement if hydraulic fluid pressure within said cylinder is dependent upon the direction of hydraulic piston movement, whereby said delay is longer if said hydraulic fluid pressure is higher.

32. The method of claim 30 further comprising monitoring hydraulic fluid pressure and changing said safety factor to increase said delay from a predetermined baseline if there is an increase in said hydraulic fluid pressure from a predetermined baseline pressure.

* * * * *